US005172826A

United States Patent [19]

Celaya

[11] Patent Number: 5,172,826

[45] Date of Patent: Dec. 22, 1992

[54] FOOD BOWL

[76] Inventor: Carlos Celaya, 124 W. 65th St., #3, Westmont, Ill. 60559

[21] Appl. No.: 811,270

[22] Filed: Dec. 20, 1991

[51] Int. Cl.[5] ..... A47G 19/02

[52] U.S. Cl. ..... 220/574; 220/575; 220/574.1

[58] Field of Search ..... 220/574, 575, 23.83, 220/23.86, 574.1

[56] References Cited

U.S. PATENT DOCUMENTS

| | | | |
|---|---|---|---|
| 766,427 | 8/1904 | Crowell | 220/575 |
| 1,379,519 | 5/1921 | Bjornsen | 220/575 |
| 2,561,022 | 7/1951 | Jones | 220/575 X |
| 2,642,731 | 6/1953 | Valenti | 220/574 |
| 2,655,016 | 10/1953 | Hudson | 220/575 |
| 3,855,119 | 12/1974 | Stephenson | 220/574 X |

FOREIGN PATENT DOCUMENTS

| | | | |
|---|---|---|---|
| 0083323 | 10/1895 | Fed. Rep. of Germany | 220/575 |
| 1505479 | 11/1967 | France | 220/575 |

*Primary Examiner*—Stephen Marcus
*Assistant Examiner*—Paul A. Schwarz
*Attorney, Agent, or Firm*—Allegretti & Witcoff, Ltd.

[57] ABSTRACT

A food bowl has a depression in its bottom for collecting the last of foods in the bowl. The depression is sloped and tapered, with a semicircular, concave end. Tipping of the bowls, to spoon out the last of the foods, is eliminated.

1 Claim, 1 Drawing Sheet

FOOD BOWL

BACKGROUND OF THE INVENTION

This invention relates to food bowls. Food bowls, such as soup and cereal bowls, are often used for individual servings of food. As the bowls are emptied, spooning the food from the bottom of the bowl requires behavior not acceptable within current, Western standards of etiquette. The bowl must be tipped to the side to cause the food to collect, or even more extreme behavior must occur. However, often a considerable amount of food remains in the bowl and is wasted.

SUMMARY OF THE INVENTION

A new food bowl allows the food in the bottom of the bowl to be spooned out. The bowl includes a spoon-receiving depression in the bottom. The depression is preferably sloped, and shaped for a spoon to fit at one end.

BRIEF DESCRIPTION OF THE DRAWING

A preferred bowl will now be described, with reference to the accompanying drawing. In the drawing.

DETAILED DESCRIPTION OF THE PREFERRED EMBODIMENT

Figure 1:
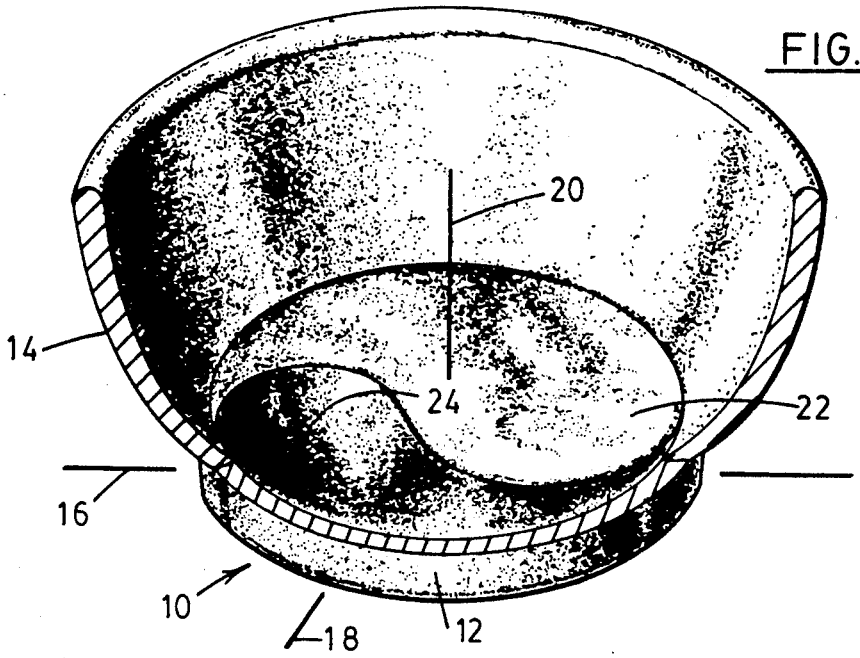
FIG. 1 is a broken-away, perspective view of the bowl.
Figure 2:
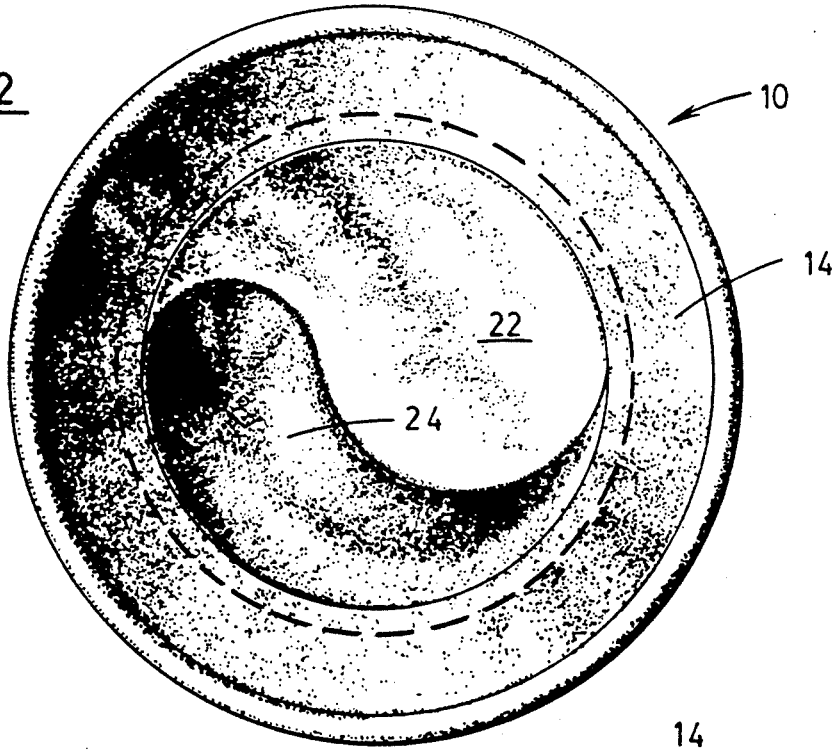
FIG. 2 is a top plan view of the bowl.
Figure 3:
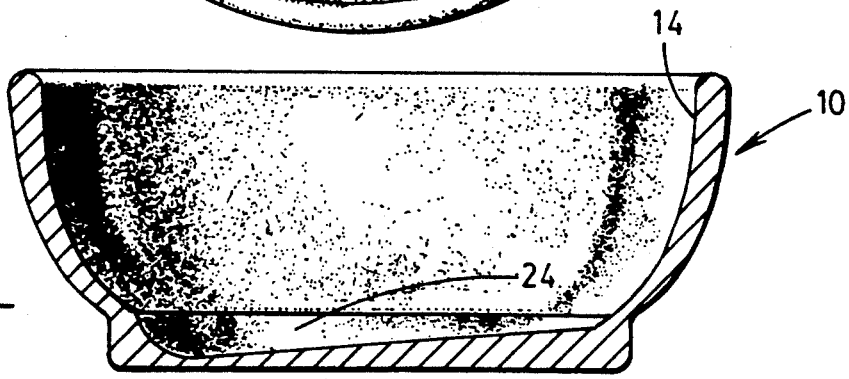
FIG. 3 is a section of the bowl along helical line 3—3 of FIG. 2.

Referring to the drawing, the preferred food bowl 10 comprises a base 12 and a wall 14. The base 12 has a two-dimensional extent in a base plane defined by intersecting lines 16–18. The base has a thickness in a direction 20 transverse to the base plane.

The wall 14 has a height in the direction 20 transverse to the base plane, and the wall extends continuously around at least a portion of the base. The portion of the base 12 being surrounded by the wall 14 defines the bottom 22 of the bowl. The wall 14 is merged with the base 12 to form the bowl.

A portion 24 of the bottom is, by definition and form, a depressed portion of the bottom. The depressed portion 24 has a thickness which is reduced from the thicknesses of the remainder of the bottom, to form a depression in the bottom of the bowl. Liquids in the bowl collect in the depression in the bottom, for easy spooning out. The depressed portion 24 has a variably reduced thickness such that the depression formed in the bottom is a sloped depression. The depressed portion is also helical, along a helical axis, i.e., helical line 3—3. Finally, the depressed portion has widths perpendicular to the helical axis, the width decreasing as thickness of the depressed portion increases. Immediately adjacent the location of maximum width, the depressed portion has a semicircular, concave end. As now apparent to the reader, the bowl collects liquids and liquid-based foods in the depressed portion of the bottom. Foods collected there are readily spooned from the bowl.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. A food bowl comprising:

a base having a two-dimensional extent in a base plane and thicknesses in a direction transverse to the base plane;

a wall having a height in the direction transverse to the base plane, the wall extending continuously around at least a portion of the base, the portion of the base being surrounded by the wall defining the bottom of the bowl, and the wall being merged with the base; and a portion of the bottom having a thickness which is reduced from the thicknesses of the remainder of the bottom, to form a depression in the bottom, whereby liquids in the bowl collect in the depression in the bottom;

the portion of the bottom having a reduced thickness being, by definition, a depressed portion, the depressed portion having a variably reduced thickness such that the depression formed in the bottom is a sloped depression;

the depressed portion further being helical, along a helical axis;

the depressed portion further having widths perpendicular to the helical axis, the widths decreasing as thickness of the depressed portion increases;

the depressed portion further having, immediately adjacent the location of maximum width, a semicircular, concave end.

* * * * *